US008482370B2

(12) United States Patent
Zurke

(10) Patent No.: US 8,482,370 B2
(45) Date of Patent: Jul. 9, 2013

(54) LOCATION OF AN NTC RESISTOR IN AN ELECTROMAGNET

(75) Inventor: Janusz Zurke, Straelen (DE)

(73) Assignee: Pierburg GmbH, Neuss (DE)

( * ) Notice: Subject to any disclaimer, the term of this patent is extended or adjusted under 35 U.S.C. 154(b) by 0 days.

(21) Appl. No.: 13/702,588

(22) PCT Filed: May 18, 2011

(86) PCT No.: PCT/EP2011/058066
§ 371 (c)(1),
(2), (4) Date: Dec. 7, 2012

(87) PCT Pub. No.: WO2011/154231
PCT Pub. Date: Dec. 15, 2011

(65) Prior Publication Data

US 2013/0076468 A1 Mar. 28, 2013

(30) Foreign Application Priority Data

Jun. 9, 2010 (DE) ..... 10 2010 023 240

(51) Int. Cl.
*H01F 27/08* (2006.01)
*H01F 41/00* (2006.01)

(52) U.S. Cl.
USPC ..... 335/217; 335/299; 336/179

(58) Field of Classification Search
USPC ..... 335/217, 299; 336/179, 192; 361/165
See application file for complete search history.

(56) References Cited

U.S. PATENT DOCUMENTS

| | | | | |
|---|---|---|---|---|
| 5,204,044 | A * | 4/1993 | Yoneshige | 264/272.15 |
| 5,628,296 | A * | 5/1997 | Herrington et al. | 123/568.21 |
| 5,722,632 | A * | 3/1998 | Rader et al. | 251/129.15 |
| 6,147,589 | A | 11/2000 | Ohmura | |

FOREIGN PATENT DOCUMENTS

| | | | |
|---|---|---|---|
| DE | 386 626 | A | 12/1923 |
| DE | 871 178 | B | 3/1953 |
| DE | 26 48 546 | C2 | 6/1977 |
| DE | 42 05 563 | A1 | 8/1993 |
| DE | 196 46 986 | A1 | 5/1998 |
| DE | 196 46 986 | B4 | 5/1998 |
| DE | 198 48 823 | A1 | 6/1999 |
| DE | 100 17 661 | C2 | 2/2002 |
| DE | 100 11 009 | B4 | 7/2008 |
| GB | 605 386 | A | 7/1948 |
| GB | 1 569 188 | | 6/1980 |
| WO | WO 2009/018954 | A1 | 2/2009 |

* cited by examiner

*Primary Examiner* — Ramon Barrera
(74) *Attorney, Agent, or Firm* — Norman B. Thot

(57) ABSTRACT

An arrangement of a NTC resistor in an electromagnet includes an electromagnetic coil comprising a main winding and a shunt winding, a coil carrier configured to have the electromagnetic coil be wound thereon, a first contact terminal and a second contact terminal configured to supply a voltage, a NTC resistor, a first contact lead comprising a first contact lead end, a second contact lead comprising a second contact lead end, and a third contact lead. The first contact lead, the second contact lead and the third contact lead are configured to interconnect the first contact terminal, the second contact terminal, the main winding, the shunt winding, and the NTC resistor. A fixing element is configured to be elastically deformable and to exert a spring force so as to fix the NTC resistor between the first contact lead end and the second contact lead end.

6 Claims, 2 Drawing Sheets

LOCATION OF AN NTC RESISTOR IN AN ELECTROMAGNET

CROSS REFERENCE TO PRIOR APPLICATIONS

This application is a U.S. National Phase application under 35 U.S.C. §371 of International Application No. PCT/EP2011/058066, filed on May 18, 2011 and which claims benefit to German Patent Application No. 10 2010 023 240.8, filed on Jun. 9, 2010. The International Application was published in German on Dec. 15, 2011 as WO 2011/154231 A1 under PCT Article 21(2).

FIELD

The present invention relates to the arrangement of a NTC resistor in an electromagnet comprising an electromagnet coil with a main winding and a shunt winding, a coil carrier on which the electromagnetic coil is wound, two contact terminals for voltage supply, a NTC resistor and contact leads for the interconnection of the contact terminals, the main winding and the shunt winding of the electromagnetic coil, and the NTC resistor.

BACKGROUND

Arrangements of NTC resistors on electromagnets are known. They serve for temperature compensation when magnetic coils with a strong variation of thermal stress are used. The electromagnetic coils usually comprise a main winding and a shunt winding wound together on the coil carrier, wherein the NTC resistor is connected in parallel with the shunt winding and this circuit is connected in series with the main winding, or the NTC resistor is connected in series with the shunt winding and this circuit is connected in parallel with the main winding. This temperature compensation is necessary since temperature variations between about −30° C. to about 150° C. exist for a magnetic coil used in a motor vehicle. The magnetic force of the coil drops as the temperature rises, the drop being due to the temperature-dependent resistance of the coil wire. This is compensated for by the use of the NTC resistors, by means of which it is achieved that the same magnetic force is generated at the coil when the pulse-width modulated signal at the contact terminals is the same.

The use of such NTC resistors is described, for example, in DE 42 05 563 A1. Here the NTC resistor is arranged in the power supply with a shunt coil being connected in parallel therewith. This is to additionally improve the consistency of the magnetic force for equal control signals. The mounting of the resistor is not part of the subject matter of this application.

The NTC resistors used in such circuits are produced as standardized components with soldered contact wires. These contact wires are typically first bent and are then soldered to contacts of the coil. The solder used either includes lead or has a melting temperature that is insufficient for production-related reasons.

Known NTC resistors have the drawbacks that sufficient strength of the connection of the NTC resistor to the contacts of the electromagnetic coil often does not exist and environmentally hazardous materials must be used. Both the required vibration resistance and the temperature resistance of the known connections is furthermore often insufficient.

SUMMARY

An aspect of the present invention is to provide an arrangement of a NTC resistor in an electromagnet which provides a safe connection of the NTC resistor to the contacts of the electromagnet even in the case of increased vibrational and thermal stress.

In an embodiment, the present invention provides an arrangement of a NTC resistor in an electromagnet includes an electromagnetic coil comprising a main winding and a shunt winding, a coil carrier configured to have the electromagnetic coil be wound thereon, a first contact terminal and a second contact terminal configured to supply a voltage, a NTC resistor, a first contact lead comprising a first contact lead end, a second contact lead comprising a second contact lead end, and a third contact lead. The first contact lead, the second contact lead and the third contact lead are configured to interconnect the first contact terminal, the second contact terminal, the main winding, the shunt winding, and the NTC resistor. A fixing element is configured to be elastically deformable and to exert a spring force so as to fix the NTC resistor between the first contact lead end and the second contact lead end.

BRIEF DESCRIPTION OF THE DRAWINGS

The present invention is described in greater detail below on the basis of embodiments and of the drawings in which.

DETAILED DESCRIPTION

Figure 1:
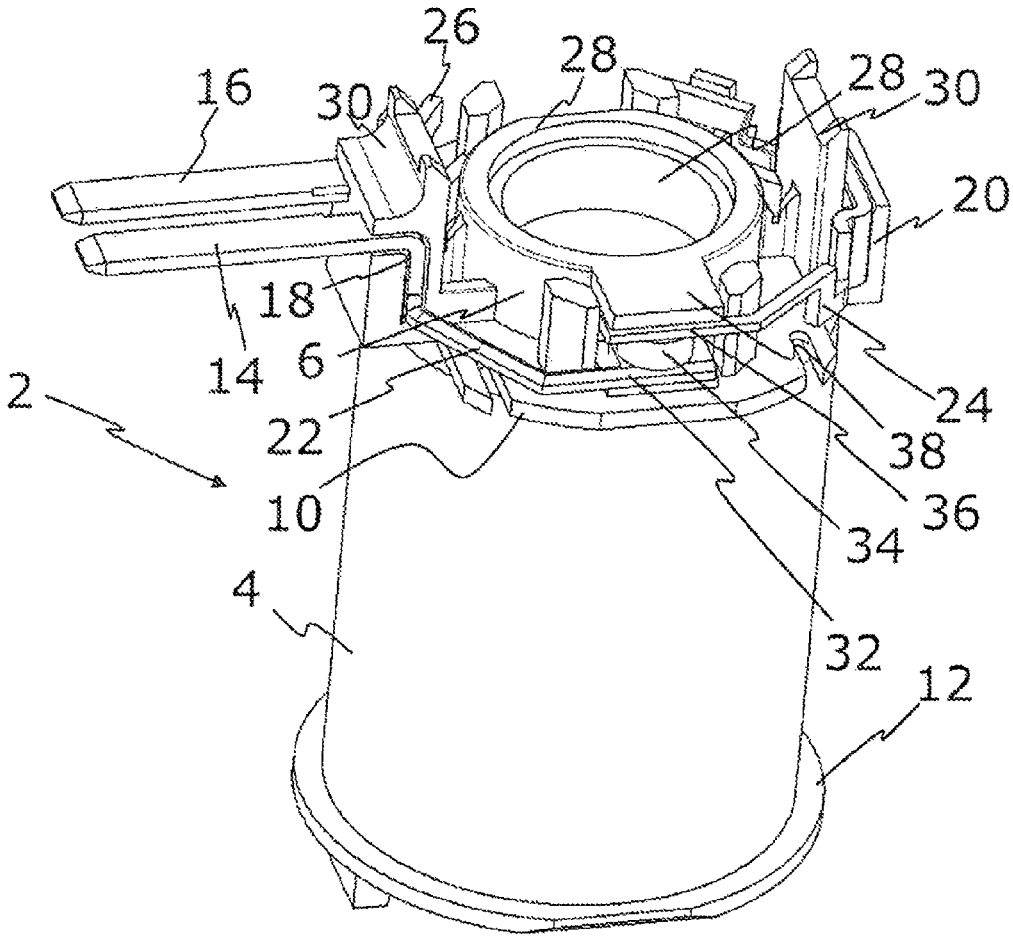
FIG. 1 shows a three-dimensional illustration of an arrangement of a NTC resistor on a coil carrier, as provided by the present invention.

Due to the fact that an elastically-deformable fixing element exerts a spring force by which the NTC resistor is fixed between the ends of two contact leads, it is possible to omit additional soldering points. The connection is entirely insensitive to thermal stresses and also has an improved vibration resistance due to the increased flexibility of the connection.

In an embodiment of the present invention, the NTC resistor can, for example, be clamped between the ends of the two contact leads, and at least one of the ends of the contact leads can be spring-loaded. That means that both terminals abut against the resistor, with the force exerted on the resistor by the two contact leads acting in the direction of the resistor, whereby the same is fixed by clamping. By exerting a spring force, a connection of the resistor to both contact leads is thus achieved without any additional fixing means.

In an embodiment of the present invention, the coil carrier comprises a projection that serves as a fixing element and biases the end of the second contact lead towards the end of the first contact lead. The spring force is thus exerted without any additional components. A particularly simple manufacture and assembly of the NTC resistor to the coil is moreover achieved.

In an embodiment of the present invention, the coil carrier can, for example, comprise an axially extending inner hollow cylindrical body from which two substantially annular plates, which delimit the electromagnet coil axially, and the projection, which is provided at the axial end of the hollow cylindrical body, extend in the radial direction, the end of the second contact lead abutting the projection between the projection and the first annular plate and the end of the first contact lead being arranged at the first plate between the projection and the first annular plate. The clamping of the NTC resistor between the two contact leads is thus effected through the spring force of the projection. In this embodiment, a particularly economic and simple manufacture and assembly is also achieved.

In an embodiment of the present invention, one end of one of the contact leads can, for example, serve as a fixing element. The spring force is thus applied directly by the contact leads which are tensioned by elastic deformation when the NTC resistor is introduced. No further components are required in this embodiment.

In an embodiment of the present invention, a spring element, serving as a fixing element, can be welded to the ends of the contact leads. This spring element may, for example, be screwed to or injection-molded into the coil carrier. Since the spring element, other than the NTC resistor, is thermally insensitive, contacting can be made by welding.

In an embodiment of the present invention, the contact leads and the contact terminals for voltage supply can, for example, be punched/bent parts. These are particularly economic to manufacture and to assemble.

In an embodiment of the present invention, the fixing element, together with the NTC resistor, can, for example, be overmoulded with plastic material so that a component is formed which is encapsulated against outside influences. A detachment at any later time is thereby reliably prevented. Such a component may also preassembled and installed in the electromagnet as a finished assembly.

An arrangement of a NTC resistor in an electromagnet is thus provided, which, in addition to having an increased thermal and vibrational strength, provides a secure connection of the NTC resistor to the contact leads which is achieved in a manner particularly simple to manufacture and to assemble.

An embodiment of an arrangement of a NTC resistor in an electromagnet, as provided by the present invention, is illustrated in the drawings and will be described hereinafter.

The arrangement according to the present invention is described with reference to an electromagnet 2 as may be used, for example, for an electromagnetic valve.

The electromagnet 2 is formed by an electromagnetic coil 4 with a main winding and a shunt winding wound upon a coil carrier 6. The coil carrier 6 is formed by an axial hollow cylindrical body 8 from which annular plates 10, 12 extend radially outward, the plates 10, 12 axially delimiting the electromagnetic coil 4.

The electric connection of the electromagnetic coil 4 is made via a first contact terminal 14 and a second contact terminal 16, via which terminals current can be supplied to the electromagnet 2. The first and second contact terminals 14, 16 are the first ends of punched/bent parts, respectively, which are retained in correspondingly shaped recesses 18, 20 formed in the coil carrier 6 and which serve as contact leads 22, 24, 26. For this purpose, different formations 30 are arranged in the region between the plate 10 and an axial end 28 of the axial hollow cylindrical body 8 of the coil carrier 6, which formations extend substantially axially from the plate 10 and in which the recesses 18, 20 are formed.

The first contact lead 22 extends from the first contact terminal 14 through the recess 18 on the surface of the plate 10 along approximately a quadrant about the axial hollow cylindrical body 8. Here, an end 32 of the first contact lead 22 is situated, in which a substantially plate-shaped NTC resistor 34 is arranged, as provided by the present invention, whose opposite axial end rests on an end 36 of the second contact lead 24 via which the shunt winding is connected in parallel with the NTC resistor 34. This end 36 of the second contact lead 24 abuts on a projection 38 that extends in a radial direction from the axial end 28 of the axial hollow cylindrical body 8. This projection 38 is slightly elastically deformed by placing the first and second contact leads 22, 24 or the NTC resistor 34. As a consequence, the projection exerts a spring force on the end 36 of the second contact lead 24 and, via the same, on the NTC resistor 34, leading to a clamping fixation of the NTC resistor 34 between the two ends 32, 36 of the contact leads 22, 24. The projection 38 thus serves as a fixing element for the NTC resistor 34. The third contact lead 26 serves to connect the second contact terminal 16 with the main winding of the electromagnetic coil 4, which is series connected with the parallel connection formed by the NTC resistor 34 and the shunt winding.

Figure 2:
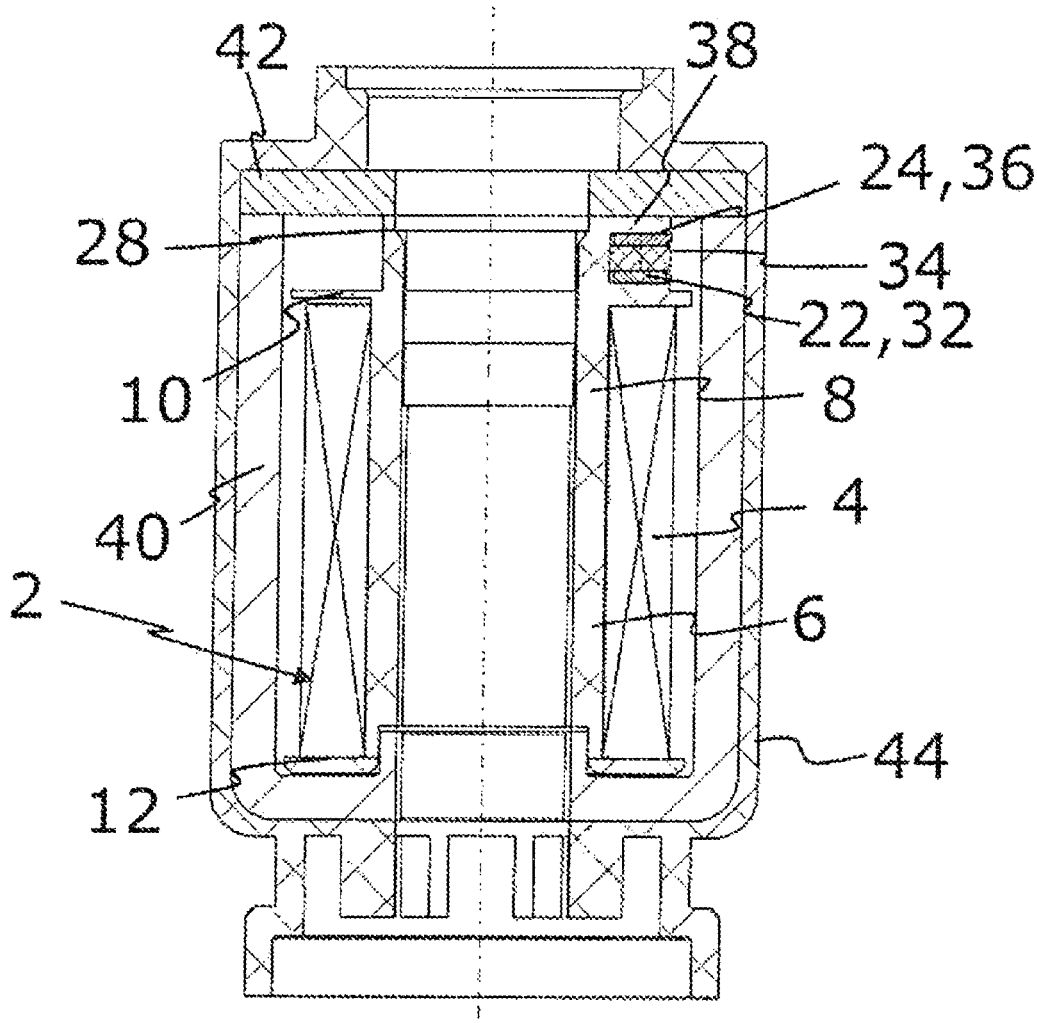
FIG. 2 shows a sectional side elevational view of an electromagnet with the arrangement according to the present invention as illustrated in FIG. 1.

In FIG. 2, further parts of the electromagnetic circuit, namely a yoke 40 and a magnetic return sheet 42, are illustrated in addition to the coil carrier 6, the electromagnetic coil 4 and the NTC resistor with the first and second contact leads 22, 24. Moreover, the electromagnet 2 is enclosed by a housing 44 that is overmoulded around the electromagnet 2.

The arrangement illustrated requires no soldering points to connect the NTC resistor with the contact leads for temperature compensation. Correspondingly, the arrangement is insensitive to thermal stress or also to mechanical vibrational stress. The clamping force can be increased further by assembling the electromagnet and overmoulding it. The arrangement described is simple to assemble and to manufacture.

The present invention is not limited to embodiments described herein; reference should be had to the appended claims. For example, the spring force could also be generated directly by the contact leads or separate spring elements could be used to clamp the NTC resistor, where it is possible in either case to omit soldering points. If desired, the ends of the leads could in addition be overmoulded with plastic material together with the NTC resistor. Such a component could also be preassembled.

What is claimed is:

1. An arrangement of a NTC resistor in an electromagnet, the arrangement comprising:

an electromagnetic coil comprising a main winding and a shunt winding;

a coil carrier configured to have the electromagnetic coil be wound thereon;

a first contact terminal and a second contact terminal, each of the first contact terminal and the second contact terminal being configured to supply a voltage;

a NTC resistor;

a first contact lead comprising a first contact lead end, a second contact lead comprising a second contact lead end, and a third contact lead, the first contact lead, the second contact lead and the third contact lead being configured to interconnect the first contact terminal, the second contact terminal, the main winding, the shunt winding, and the NTC resistor; and a fixing element configured to be elastically deformable and to exert a spring force so as to fix the NTC resistor between the first contact lead end and the second contact lead end.

2. The arrangement as recited in claim 1, wherein the NTC resistor is clamped between the first contact lead end and the second contact lead end, and at least one of the first contact lead end and the second contact lead end is spring loaded.

3. The arrangement as recited in claim 2, wherein the coil carrier comprises a projection which is configured to serve as the fixing element and to bias the second contact lead end in a direction towards the first contact lead end.

4. The arrangement as recited in claim 3, wherein the coil carrier comprises a hollow cylindrical body which extends axially, from which hollow cylindrical body a first annular plate and a second annular plate extend so as to delimit the electromagnetic coil in an axial direction, and from which the projection arranged at an axial end of the hollow cylindrical body extends in a radial direction, the second contact lead end abuts against the projection between the projection and the first annular plate, and the first contact lead end is arranged at the first annular plate between the projection and the first annular plate.

5. The arrangement as recited in claim 1, wherein at least one of the first contact lead end and the second contact lead end serves as a fixing element.

6. The arrangement as recited in claim 1, wherein the first contact lead, the second contact lead, the third contact lead, the first contact terminal and the second contact terminal are each punched/bent parts.

* * * * *